US005174705A

United States Patent [19]

Detterman et al.

[11] Patent Number: 5,174,705

[45] Date of Patent: Dec. 29, 1992

[54] APPARATUS AND METHOD FOR RUBBING THE SPINES OF CASE BOUND BOOKS

[75] Inventors: Don E. Detterman, Willard; David J. Bruns; Paul E. Depinet, both of Tiffin, all of Ohio

[73] Assignee: R. R. Donnelley & Sons Company, Chicago, Ill.

[21] Appl. No.: 822,534

[22] Filed: Jan. 17, 1992

[51] Int. Cl.[5] ..... B42C 11/00

[52] U.S. Cl. ..... 412/1; 412/5; 412/21

[58] Field of Search ..... 412/1, 4, 5, 18, 19, 412/21, 37, 8, 9, 24

[56] References Cited

U.S. PATENT DOCUMENTS

| | | | |
|---|---|---|---|
| 2,516,446 | 7/1950 | Budden | 412/1 |
| 2,549,890 | 4/1951 | Burls | 412/21 |
| 3,394,418 | 7/1968 | Thorp | 412/21 |
| 4,505,629 | 3/1985 | Lynch | 412/5 |
| 4,556,353 | 12/1985 | Ehlermann | 412/5 |
| 4,565,477 | 1/1986 | Axelrod | 412/5 |

*Primary Examiner*—Mark Rosenbaum
*Assistant Examiner*—William Fridie, Jr.
*Attorney, Agent, or Firm*—Arnold, White & Durkee

[57] ABSTRACT

An apparatus and method for rubbing down spines of case bound books includes at least one case-in wing that carries case bound books. Each case-in wing includes a leading edge on which the spine of each case bound book is positioned. The case-in wing is moved at a first predetermined rate along a first path. The apparatus includes at least one rub down roller that is moved at a second predetermined rate along a second path. The second path crosses and is at an angle to the first path. During operation, the rub down roller rolls along the entire length of the spine of the book on the case-in wing. The second predetermined rate and the angle of the second path relative to the first path are selected such that the rub down roller moves at the same speed as the case-in wing to maintain a constant distance between the rub-down roller and the spine of the book.

7 Claims, 4 Drawing Sheets

APPARATUS AND METHOD FOR RUBBING THE SPINES OF CASE BOUND BOOKS

BACKGROUND OF THE INVENTION

A. Field of the Invention

The present invention relates to a new and improved apparatus for rubbing down the spines of case bound books, and to a new and improved method for rubbing down the spines of case bound books.

B. Description Of The Background Art

In assembling case bound books and securing a case to the pages or leaves of the book, extruded glue beads are applied to the spine of the book. If the glue beads are not smoothed out, they can result in ridges and bumps that are visible through the case and results in the case not adhering to the book body. Accordingly, in the process of assembling case bound books, the spine is rubbed to smooth out the ridges and bumps formed by the beads of glue. The rub down process is complicated, however, by the fact that it is preferred that the production speed of book assembly is not slowed down by the rubbing down process. A further complication is that the rubbing down process should be performed in a manner that does not rapidly wear out the equipment.

Rub down processes have been accomplished through the use of spring-loaded pads or stationary mechanisms. Experience has shown that these mechanisms impose an undue force on the case-in wing which reduces the machine life. In addition, these mechanisms subject the books to forces that slide the books on the case-in wings resulting in uneven spreading of the glue, non-uniform glue thickness, and incomplete rubbing of the spine. To correct these disadvantages excess glue must be applied to the spine. The excess glue increases the cost and weight of the books.

There is a need for an apparatus for rubbing down the spines of case bound books that maintains a fixed distance from the case-in wing. Such an apparatus would caliper glue beads to a uniform thickness and coverage across the spines of case bound books, while minimizing the force imposed on the case-in wing carrying the books. In addition, the apparatus would minimize any forces tending to slide the books on the case-in wings. This apparatus would reduce the amount of glue required to obtain full glue coverage and maximize the mechanical bonding across the entire area of each book spine.

SUMMARY OF THE INVENTION

Briefly, the present invention is directed to a new and improved apparatus and method for rubbing down the spines of case bound books. The apparatus includes at least one case-in wing on which books with cases or covers to be secured to each book are carried. A first assembly moves the case-in wing at a first predetermined rate along a first defined path.

The apparatus also includes at least one rub down roller intended to be rolled over the spines to caliper glue beads to a uniform thickness and coverage across each spine. A second assembly is provided for moving the rub down roller at a second predetermined rate along a second defined path. The second defined path is at an angle to and crosses over the first defined path such that the rub down roller engages and rolls over the entire length of each spine of each book carried on the case-in wing. The second predetermined rate of movement for the rub down roller is selected to maintain the rub down roller at a constant distance from the case-in wing thereby maintaining a uniform force and avoiding an undue force being applied to the case-in wing and apparatus for rubbing down the spine.

BRIEF DESCRIPTION OF THE DRAWINGS

Other objects and advantages of the invention will become apparent upon reading the following detailed description and upon reference to the drawings in which.

Figure 1:
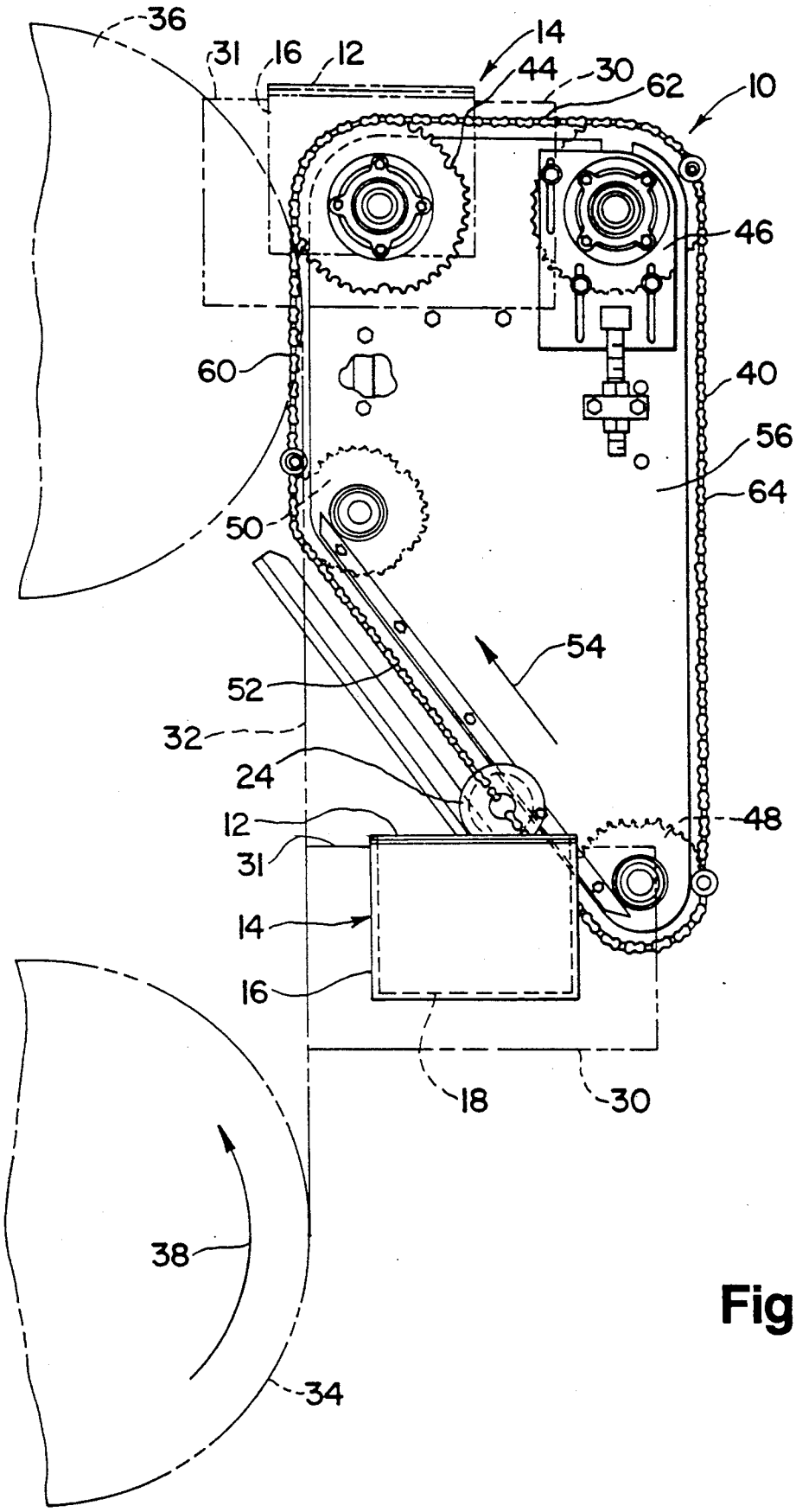
FIG. 1 is a front view of an apparatus for rubbing down the spines of case bound books constructed in accordance with the principles of the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 4:
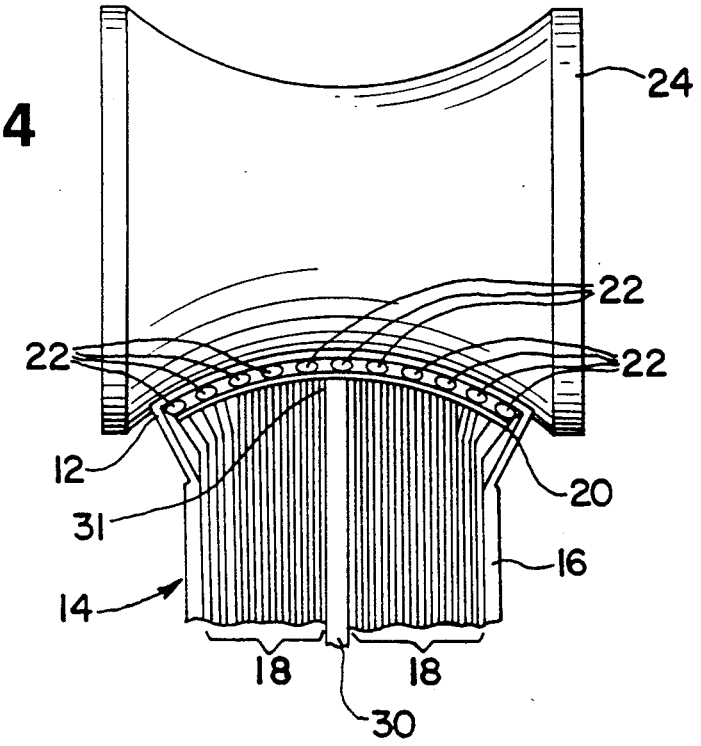
FIG. 4 is a view of a roller engaging the spine of a case bound book as viewed from a position forward of the roller and illustrating extruded glue lines.
Figure 5:
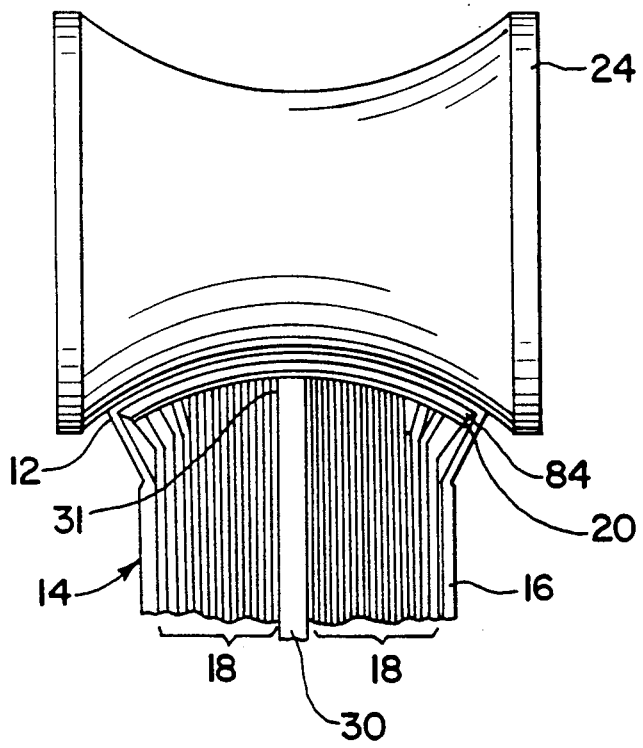
FIG. 5 is a view similar to FIG. 4 as viewed from behind the roller and illustrating the spread out glue after the roller has rubbed down the spine of the case bound book.

Referring to the drawings, there is illustrated an apparatus generally designated by the reference numeral 10. The apparatus 10 rubs down spines 12 of case bound books 14. As best illustrated in FIGS. 4 and 5, each case bound book 14 includes a case or cover 16, and a plurality of pages or leaves 18. To secure the pages 18 to the cover or case 16, a liner 20 is secured to the ends of the pages 18 and glue 22 is extruded in beads or rows between the spine 12 and the liner 20. If not smoothed out, the extruded beads or rows of glue 22 leave ridges and bumps that are visible through the case 16. Consequently, there is a need to rub down the spine 12 to caliper the glue beads 22 to a uniform thickness and coverage and to remove any ridges and bumps. Glue beads that are not rubbed down do not provide a mechanical bond between the book and the case.

Figure 2:
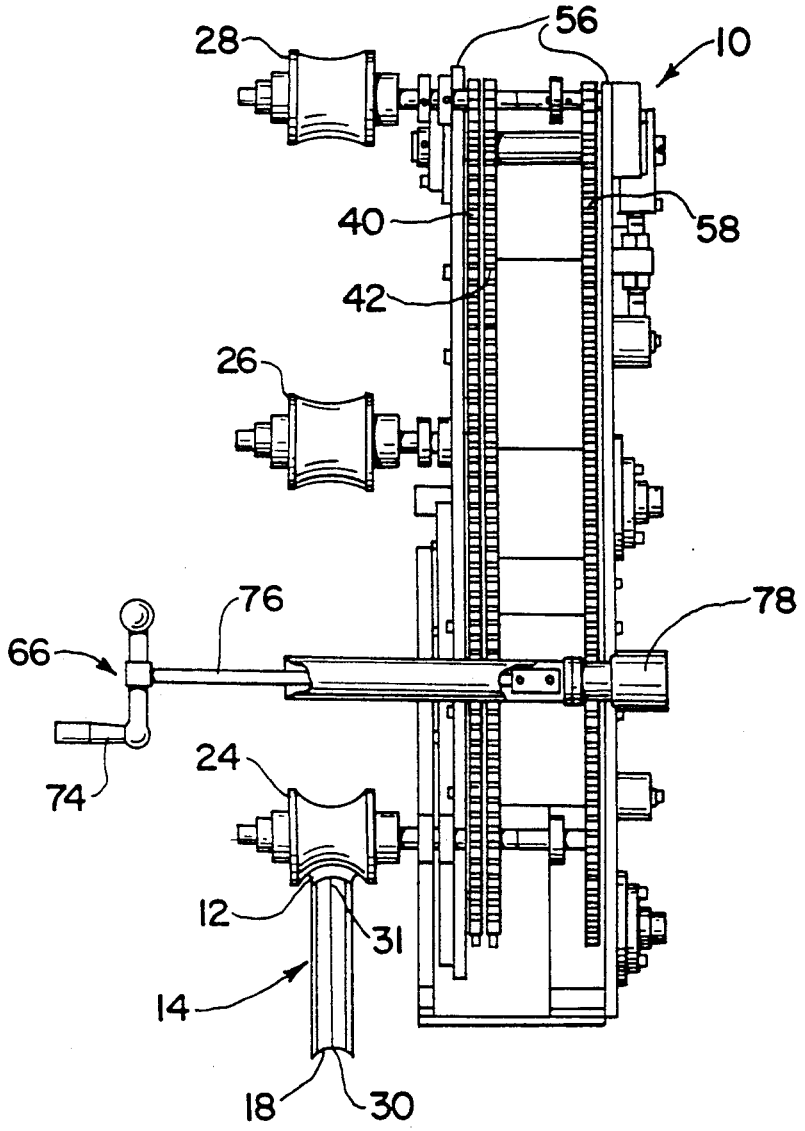
FIG. 2 is an end view of the assembly illustrated in FIG. 1.

The apparatus 10 rubs down the spines 12 of case bound books 14 by rolling one of three rollers 24, 26 and 28 over the spine 12 of each case bound book 14. As best illustrated in FIGS. 2, 4 and 5, the rollers 24, 26 and 28 are each configured in a concave or hourglass shape. The curvature of each roller 24, 26 and 28 substantially conforms to the curvature of the spines 12.

In order to caliper the glue beads or rows 22 to a uniform thickness and coverage across each spine 12, the rollers 24, 26 and 28 are rolled along the full length of each spine 12 at a constant distance from each spine 12. This rub down process preferably occurs at production speed such that the rub down process does slow down the production of case bound books 14.

In order to accomplish all of the desired results, each case bound book 14 to be rubbed down is mounted on a case-in wing 30. Specifically, each case-in wing 30 includes a leading edge 31. The case bound books 14 are mounted on the case-in wings 30 by placing the case-in wing 30 between the leaves 18 of the book with the spine 12 resting on the leading edge 31. As best illustrated in FIG. 1, the case-in wings 30 are mounted on a continuous belt or chain 32 that is moved by a pair of rollers or sprockets 34 and 36. Each case-in wing 30 either has mounted on it or picks up a case bound book 14 with a spine 12 to be rubbed down. Each case bound book 14 mounted on a case-in wing 30 moves vertically upward toward and to the sprocket 36 which like the sprocket 34 is rotating in the direction of the arrow 38. This direction is counter-clockwise as viewed in FIG. 1. The sprockets 34 and 36 are rotating at production line speeds such that the case-in wing 30 and the case bound book 14 move vertically as viewed in FIG. 1 at production speed.

To accomplish the rubbing down of the spine 12 of each case bound book 14 on a case-in wing 30, each roller 24, 26 and 28 must engage the spine 12 at one end, roll along the entire length of the spine 12 while traveling vertically upward with the case bound book 14 and the case-in wing 30, and move out of the way of the case-in wing 30 at the top of the vertical travel of the case-in wing 30. Preferably, this all occurs at production line speed. The apparatus for rubbing down the spines of case bound books 10 accomplishes this operation by moving the rollers 24, 26 and 28 along a path or track defined by dual chains 40 and 42 (FIGS. 1 and 2). The chains 40 and 42 are mounted on sprockets 44, 46, 48 and 50. These sprockets 44, 46, 48 and 50 define the path of the chains 40 and 42. This path is substantially rectangular except for one angular side or path 52. As the rollers 24, 26 and 28 travel in the direction of the arrow 54 along the angular path 52, each roller 24, 26 and 28 engages and rolls along a spine 12 of a case bound book 14.

The sprockets 44, 46, 48 and 50 are rotatably mounted within a housing or casing 56. A drive chain 58 is mounted within the casing 56 (FIG. 2). The drive chain 58 drives the sprockets 44, 46, 48 and 50 and thus the rollers 26 and 28 through the path best illustrated in FIG. 1. Each roller 24, 26 and 28 moves along the angular path 52 to a vertical path 60. The vertical path 60 is parallel to or travels along the same path as the case-in wing 30. The vertical path 60 turns to a horizontal path 62 moving each roller 24, 26 and 28 away from each case-in wing 30. Each roller 24, 26 and 28 returns to the angular path 52 by traveling downward as viewed in FIG. 1 along a longer vertical path 64.

The positions of the rollers 24, 26 and 28 relative to each other are such that as each case bound book 14 on a case-in wing 30 approaches the apparatus for rubbing down the spine of a case bound book 10, a roller 24, 26 and 28 engages a spine 12 of a case bound book 14 at one end; specifially, at the right end of the spine 12 as viewed in FIG. 1. The roller 24, 26 or 28 then rolls along the length of the spine 12 while at the same time moving vertically at production speed. This is accomplished by the angle of the path 52 relative to the path of the case-in wing 30 and the speed of travel of each roller 24, 26 and 28. The angle of the path 52 relative to the path of the case-in wing 30 and the speed of the rollers 24, 26 and 28 are selected such that each roller maintains a fixed distance or gap from the case-in wing 30 while rubbing down a spine 12. This ensures that the rollers 24, 26 and 28 caliper the glue beads 22 to a uniform thickness and coverage across the entire length of each spine and avoid imposing an undue force on the case-in wing 30 that would reduce the machine life or cause the case bound books 14 to slide on the case-in wings 30.

Figure 3:
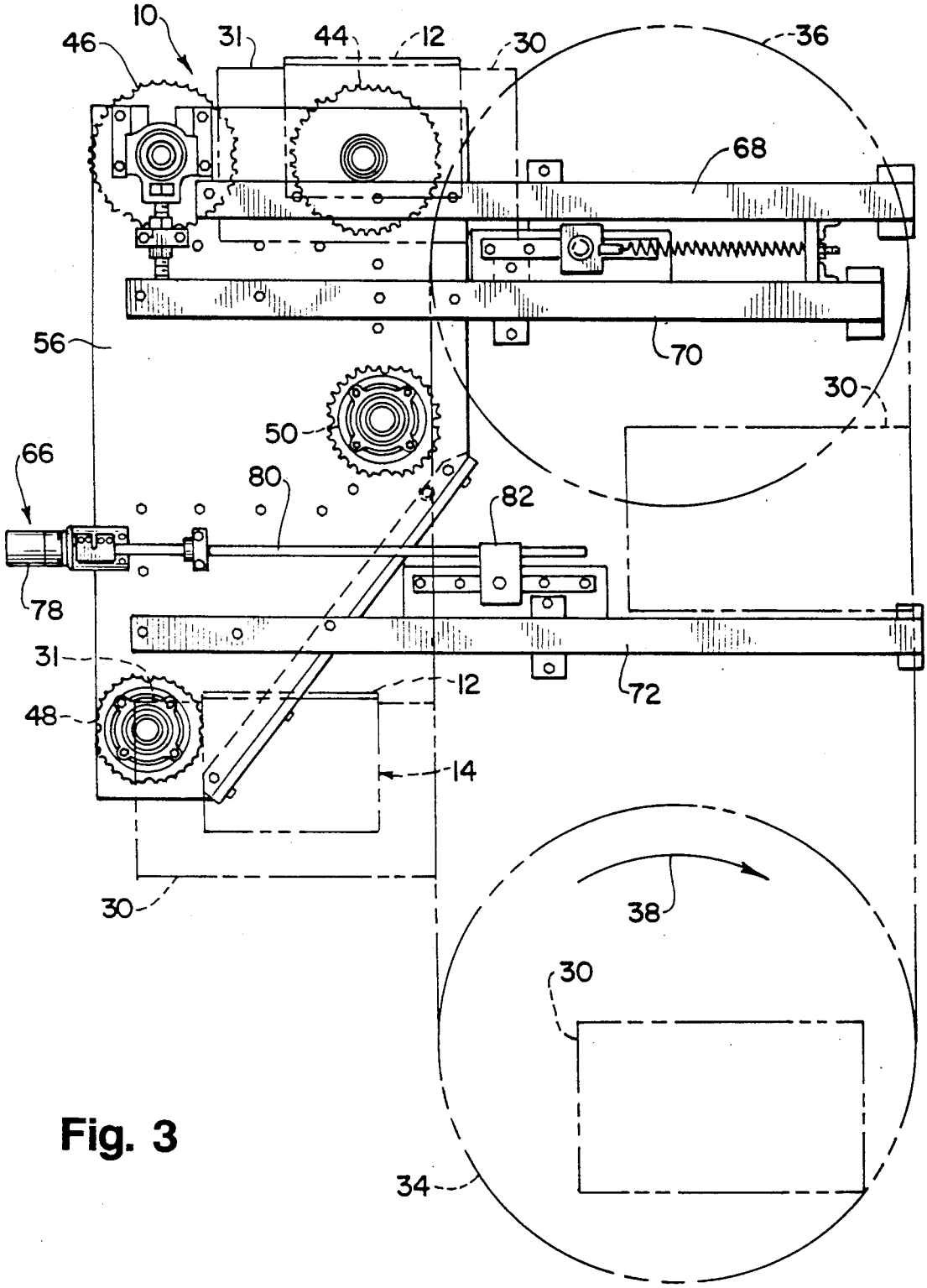
FIG. 3 is a rear view of the apparatus illustrated in FIG. 1.

The fixed distance or gap between each roller 24, 26 and 28 and each case-in wing 30 may be adjusted to accommodate spines 12 and case bound books 14 of different sizes. The gap may be adjusted by using a crank generally designated by the reference numeral 66. As best illustrated in FIG. 3, the apparatus 10 for rubbing down the spines 12 of case bound books 14 is mounted on three support brackets 68, 70 and 72. The support brackets 68, 70 and 72 are bolted to a tower or similar foundation. The crank 66 includes a handle 74 (FIG. 2) connected to a first arm or extension 76. The first arm or extension 76 is coupled by a coupling 78 to a second arm 80. The second arm 80 is threadably mounted in a block 82 that is secured to the support bracket 72. By rotating the handle 74 of the crank 66, the gap between the rollers 24, 26 and 28 and the case-in wings 30 can be adjusted to accommodate different size case bound books 14 and to provide phasing adjustment of the rollers to the case in the wing. Once a gap is selected through the use of the crank 66, this gap remains constant through the rubbing down procedure, and will allow the machine to continue operation in the event of an empty wing.

With specific reference now to FIGS. 4 and 5, the action of a rub down roller 24 on a spine 12 of a case bound book 14 is illustrated. Referring initially to FIG. 4, a portion of a case bound book 14 is viewed from in front of the roller 24. As seen in FIG. 4, a plurality of beads or rows of extruded glue 22 are positioned between the liner 20 and the spine 12 of the cover or case 16. If these beads 22 are not rubbed down, they will leave ridges or bumps that can be seen and felt through the cover 16. Turning now to FIG. 5, the spine 12 is viewed from behind the roller 24. As illustrated, the rows or beads of glue 22 have been calipered to a uniform layer of glue 84. The rub down process using the roller 24 serves to eliminate the ridges or bumps that could result from the beads of glue 22. In addition, the rub down provided by the roller 24 spreads out the glue to a uniform thickness over the entire spine 12 ensuring a more uniform thickness and coverage. The result is that less glue is needed to obtain full glue coverage while the mechanical bonding across the entire spine 12 is maximized. Also the rubdown process adheres the cover to the book spine.

We claim:

1. An apparatus for rubbing down spines of case bound books, comprising:

at least one case-in wing for carrying a case bound book;

a first assembly for moving the case-in wing at a first predetermined rate along a first defined path;

at least one rub down roller; and a second assembly for moving said at least one rub down roller at a second predetermined rate along a second defined path; said second defined path being at an angle to and crossing over said first defined path, wherein said at least one rub down roller engages and rolls over a spine of a book carried on said case-in wing; said second predetermined rate being set to maintain said at least one rub down roller at a constant distance from said case-in wing as said at least one rub down roller rolls along said spine of said book carried on said case-in wing.

2. The apparatus for rubbing down spines of case bound books set forth in claim 1 wherein said case-in wing includes a leading edge, said book mounted on said case-in wing with said spine of said book extending along said leading edge.

3. The apparatus for rubbing down spines of case bound books set forth in claim 1 further comprising an adjustment member for adjusting the distance of said rub down roller from said case-in wing.

4. The apparatus for rubbing down spines of case bound books set forth in claim 1 further comprising a plurality of rub down rollers.

5. A method for rubbing down a spine of a case bound book, comprising the steps of:

moving a case-in wing at a first rate in a first direction;

mounting a case bound book on said case-in wing;

rolling a rub down roller over a spine of said case bound book;

moving said rub down roller at a second rate and at an angle to said first direction; and selecting said angle and second rate to maintain said rub down roller at a constant distance from said case-in wing as said rub down roller rolls over the entire length of said spine while said case-in wing moves in said first direction.

6. The method for rubbing down a spine of a case bound book claimed in claim 5 wherein the first rate at which said case-in wing is moved is at production line speed.

7. The method for rubbing down a spine of a case bound book claimed in claim 5 further comprising the step of adjusting the distance of said rub down roller from said case-in wing.

* * * * *